United States Patent [19]

Stettler

[11] 4,057,215

[45] Nov. 8, 1977

[54] COLLAPSIBLE EASEL FOR ARTISTS

[76] Inventor: Gene A. Stettler, 641 Florida Ave., York, Pa. 17404

[21] Appl. No.: 713,716

[22] Filed: Aug. 12, 1976

[51] Int. Cl.[2] ..... A47B 97/08

[52] U.S. Cl. ..... 248/460

[58] Field of Search ..... 248/460, 461, 462, 463, 248/464, 465, 452, 454, 455, 456, 457, 165, 166; 108/17, 38

[56] References Cited

U.S. PATENT DOCUMENTS

| | | | |
|---|---|---|---|
| 751,408 | 2/1904 | Pettit | 248/452 |
| 1,765,343 | 6/1930 | Madsen | 108/38 |
| 2,064,232 | 12/1936 | Tepper | 248/460 |
| 2,953,341 | 9/1960 | Howell | 248/464 |
| 3,095,665 | 7/1963 | Killen | 248/455 |
| 3,201,080 | 8/1965 | Rose | 248/460 |
| 3,244,450 | 4/1966 | Boutin | 248/460 |

FOREIGN PATENT DOCUMENTS

| | | | |
|---|---|---|---|
| 184,107 | 4/1907 | Germany | 248/460 |
| 69,504 | 9/1949 | Norway | 248/460 |
| 342,816 | 2/1931 | United Kingdom | 248/460 |
| 1,413,883 | 11/1975 | United Kingdom | 248/460 |

*Primary Examiner*—Marion Parsons, Jr.
*Attorney, Agent, or Firm*—C. Hercus Just

[57] ABSTRACT

A collapsible easel for artists and the like to support canvases, artists' boards and otherwise comprising a horizontal frame member having an upright support extending therefrom, two pairs of legs respectively pivotally movable from compact positions extending from said frame member in the same direction as said support to positions extending downwardly from said frame member and at an acute angle to each other, and a pair of panels hinged suitably along one edge to each other, one panel being hinged to said frame member and positionable substantially horizontally to form a shelf and the other panel extending downwardly and inwardly to position the lower edge adjustably along the forward pair of legs to form a brace for said shelf panel and said panels being disposable in planar relationship and movable into overlying position along the front face of said upright support so as to overlie a painting or drawing supported by said support and thereby protect the same.

6 Claims, 10 Drawing Figures

COLLAPSIBLE EASEL FOR ARTISTS

BACKGROUND OF THE INVENTION

Conventional easels used by artists in studios normally have a pair of rigid forward legs and one or more pivoted legs extending rearwardly therefrom, the forward legs having at least one horizontal supporting bar thereon upon which the lower edge of a canvas or artists board is supported in somewhat rearwardly inclinded manner and the upper edge of the canvas or board may or may not be clamped in some way relative to the forward legs. Easels of this type are highly satisfactory for use in studios but for purposes of transporting the same to various locations and especially to either indoor or outdoor locations for use, as well as storage of the same in living quarters such as apartments and the like, such conventional unitary leg type of easels are awkard and consume more space than usually is available in storage closets, automobiles and the like. As a result, many attempts have been made over the years to provide collapsible type easels which, for the most part are provided with some type of pivoted and extensible and retractable leg. The outstanding objective in providing collapsible type easels is to render the same as compact as possible when they are in collapsed condition and, preferably, have no loose members which have to be accounted for when the easel is to be used or while being transported.

A number of collapsible easels previously developed have been directed toward arranging the various components to be compactly arranged in a suitcase or other forms of enclosing means and typical examples of these are illustrated in the following U.S. Pat. Nos:

2,549,306 - Greene — 1951
2,565,078 - Kaplan — 1951
2,935,812 - Adami — 1960
3,202,471 - Wilson — 1965

One difficulty associated with designing a collapsible easel capable of being contained within a suitable carrying case is that it normally limits the size of the easel and it is the principal objective of the present invention to provide an easel which has all of the attributes of being compact and equivalent to being contained within an enclosure without actually having an enclosure and, in addition, providing an easel of substantially normal proportions when the same is arranged in operative position.

SUMMARY OF THE INVENTION

It is one of the principal objectives of the present invention to provide a collapsible easel in which the structure is relatively simple but strong and durable as well as providing for minimum operations required to change the easel from compact, storage condition to extended, operative position and all elements of the easel are connected together in either of said positions so that no loose parts need to be accounted for either while using the easel or while storing or transporting the same.

It is another object of the invention, ancillary to the foregoing object, to provide an elongated, normally horizontal frame member having opposite faces, a perpendicular support extending upward from said frame member between the opposite ends thereof, a first pair of legs pivotally connected to opposite end portions of one face of the frame member, a second pair of legs pivotally connected to opposite end portions of the other face of the frame member, said pairs of legs when stored in inoperative position extending from the horizontal frame member in the same direction as the support and being disposed on opposite sides of a plane within which the support is disposed, while to arrange the legs in operative position, the same are pivotally moved through arcs of substantially 180° and the first pair of legs being fixed releasably within the same plane as the front face of said horizontal frame member and the second pair of legs being disposed at an acute angle thereto to provide ample support for the easel, and the easel also being provided with shelf means in the form of a pair of panels hingedly connected together along one edge and the opposite edge of one of the panels being pivotally connected to the horizontal frame member and adapted to extend forwardly therefrom to comprise a shelf, while the other panel is positioned to extend downwardly and inwardly into engagement with the front face of said first pair of legs to brace the shelf panel in operative position.

It is a further object of the invention to provide a normally horizontal pair of rails vertically adjustably carried by said support member and when the easel is disposed in compact, storage position, the shelf and brace panels referred to above are disposed in planar relationship and extend across said horizontal rails on said support as well as any painting or drawing supported thereby so as to protect the front face of said painting or drawing during storage or transportation of the easel.

Still another object of the invention is to provide vertically extensible auxiliary supporting means preferably in the form of a pair of rod-like members having lateral extentions at the upper ends thereof and said rod members being longitudinally adjustable with respect to said vertical support when the same is in operative position for purposes of permitting attachment of canvases and artists' boards to the easel which are of a greater vertical dimension than the length of said support.

A still further object of the invention is to provide said pairs of legs in the form of compound legs respectively including a leg member which is hingedly connected to the horizontal frame member and a longitudinally extensible outer leg member slidable relative to the hingedly connected leg member and preferably having adjustably projectable pointed members longitudinally movable relative to the outer ends of said outer leg members and adapted to be projected into turf or soil when desired.

One other object of the invention is to provide handle means in the upper end of said support which extends upward from said horizontal frame member, said handle means projecting above any other elements of the easel when the components thereof are disposed in compact, collapsed condition such as when being stored or transported.

Details of the foregoing objects and of the invention, as well as other objects thereof, are set forth in the following specification and illustrated in the accompanying drawings comprising a part thereof.

DETAILED DESCRIPTION

Figure 1:
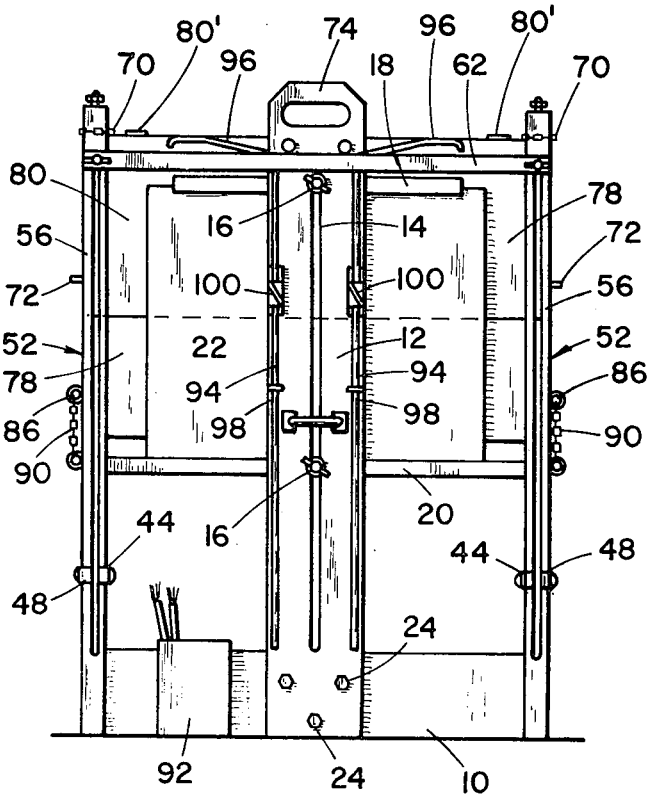
FIG. 1 is a front elevation of the collapsible easel comprising the present invention and showing the same in compact, collapsed condition.
Figure 2:
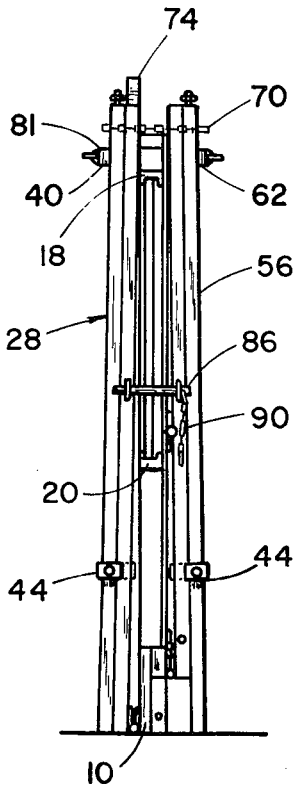
FIG. 2 is a side elevation of the easel shown in FIG. 1.

Referring to FIGS. 1 and 2, the collapsible easel comprising the present invention is illustrated respectively in front and side elevations in collapsed condition such as the preferred arrangement of the easel when it is being stored or transported. Without limitation thereto, but for purposes of providing a concept of the compact nature of the same, a prototype of the easel which has been found to be very statisfactory is approximately thirty inches high and twenty four inches wide across the face and approximately six inches wide in side elevation. Said prototype also has been made from wood and produces a highly attractive and esthetic type of easel when wood is employed but it is to be understood that other types of suitable material such as aluminum extrusions or tubes, molded plastic members including rods and sheets, or otherwise, may be employed to manufacture the easel in a manner to embody the useful and novel features thereof, details of which are as follows.

Figure 3:
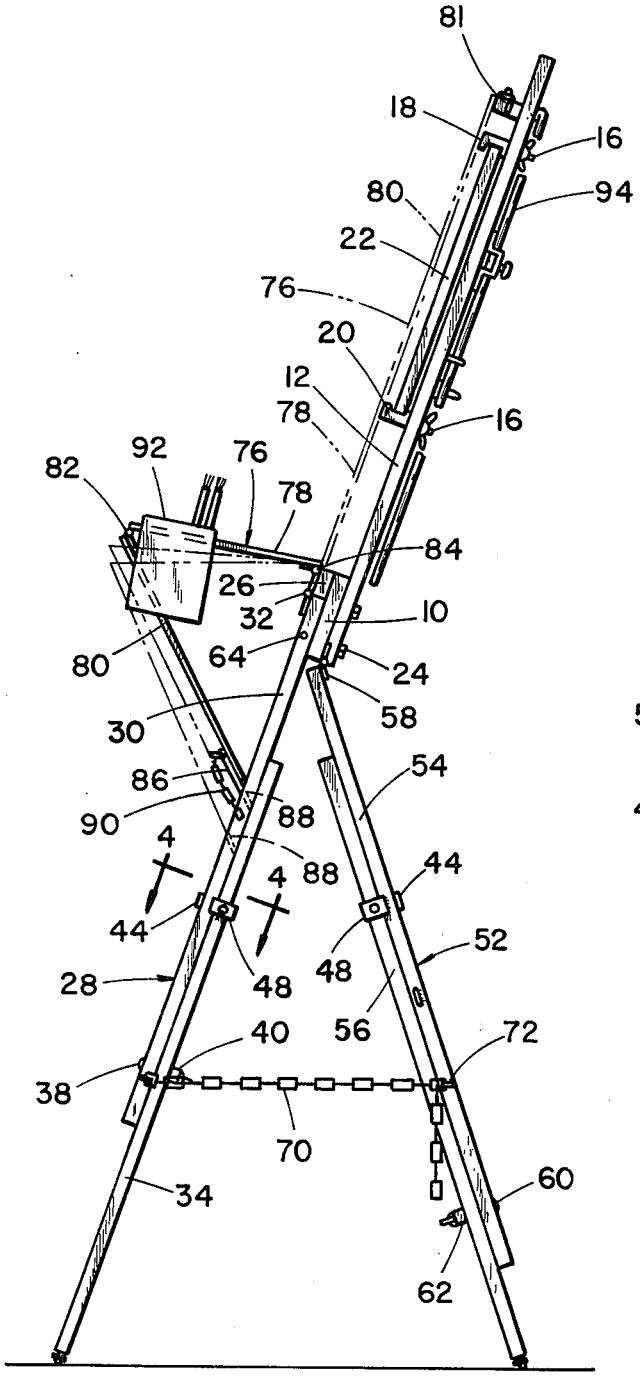
FIG. 3 is a side elevation of the easel shown in FIGS. 1 and 2 when the components thereof are extended to operative position, said view also showing the shelf means of the invention illustrated in full lines in one position and other alternate positions thereof being illustrated in phantom in said figure.
Figure 5:
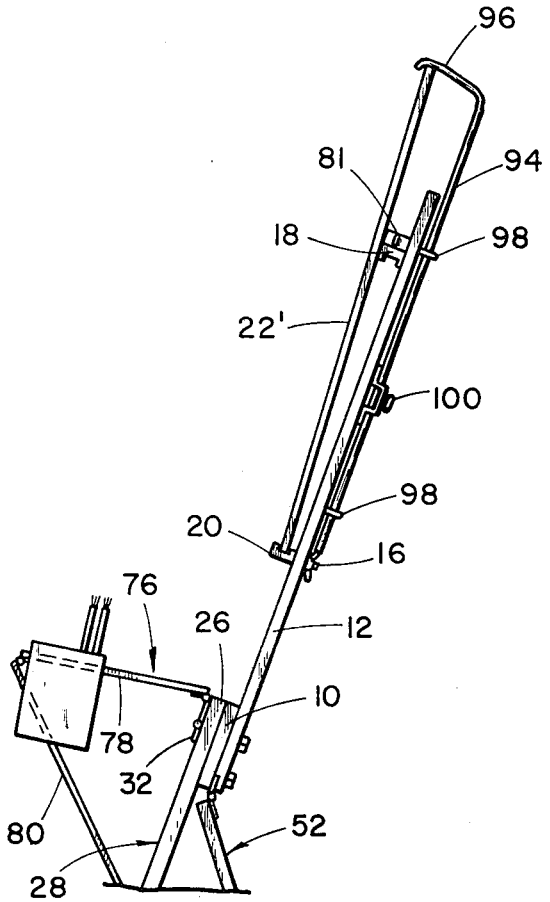
FIG. 5 is a fragmentary view similar to the upper portion of FIG. 3 and illustrating the use of auxiliary supporting means connected to the principal support of the easel and showing said auxiliary supporting means in operative engagement with the upper edge of an exemplary canvas or artist board.

The easel comprises an elongated horizontal frame member 10 which is the basic element to which substantially all of the other elements of the easel are connected, either directly or indirectly. Extending perpendicularly from the frame member 10, intermediately between the opposite edges thereof, is a support 12 which is best shown in FIGS. 1, 3 and 5. Support 12 is provided with a longitudinal slot 14 shown best in FIG. 1, for purposes of receiving bolts and wing nuts 16 by which a pair of horizontal, preferably grooved rails 18 and 20 are secured in vertically spaced, parallel relationship to each other so as to extend transversely with respect to support 12 and adapted to respectively receive an artist canvas 22 therebetween. It is understood that the designation "canvas" also is intended to embrace other art boards of which there are a number of types upon which artists sketch and paint pictures.

The lower end of support 12 is fixed to horizontal frame member 10 intermediately between the opposite ends thereof by a plurality of bolts or screws 24.

Figure 4:
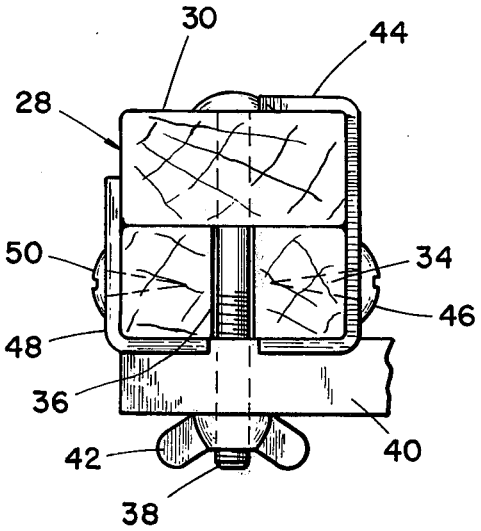
FIG. 4 is a transverse sectional view showing details of the front leg structure illustrated in FIG. 3 as seen on the line 4—4 thereof.

A supplemental frame member 26, which is narrower than the horizontal frame member 10 is secured by suitable screws or the like to the forward face of frame member 10 adjacent the upper edge thereof as best shown in FIG. 3. Said supplemental frame member 26 primarily is provided to serve as means to support a plurality of hinges respectively for several purposes. One purpose is to connect a first pair of composite legs 28 to the frame member 10 respectively adjacent opposite ends thereof, said legs each comprising a hinged leg member 30 to which a hinge 32 is connected at the upper end thereof for purposes of attaching it hingedly to supplemental frame member 26, and each composite leg 28 also including an outer leg member 34 which is slidably connected to hinged leg member 30, the latter being provided with a longitudinally extending slot 36, see FIG. 4, through which a guide and clamping bolt 38 extends, said bolt also extending through a transverse brace member 40, the end view of which is shown in FIG. 3 and a fragmentary portion of which is shown in FIG. 4. A wing nut 42 affords ready clamping means. Also, an additional positioning and guide strap 44 which, as shown in FIG. 4 is substantially U-shaped, extends around the opposite outer surfaces of the leg members 30 and 34 and is secured to one of the same by a screw 46. An additional angle guide member 48 is fixed by another screw 50 to leg member 34, as shown in FIG. 4, and one end of the same overlies one side of the other leg member 30 to facilitate maintaining the relatively slidably movable leg members in longitudinal alignment with respect to each other.

The easel is also provided with a second pair of composite legs 52 which, as shown in FIG. 3, are similar to the first pair of legs 28 and respectively comprise hinged leg members 54 and outer leg members 56, the hinged leg members 54 being connected at the upper ends thereof by hinges 58 to the lower edge of horizontal frame member 10 as shown in FIG. 3. The outer leg members 56 are longitudinally slotted as shown in FIG. 1 for receiving clamping bolts 60 which are similar to bolts 38 in the first pair of legs 28, said bolts extending through the opposite ends of a transverse brace member 62 and a wing nut is mounted on the free end of the bolts 60 to clamp the outer leg members 56 at a desired extended position with respect to the hinged leg members 54 of the composite legs 52. Similarly, positioning and guide straps 44 and angle guide members 48 are connected to the leg members of each of the composite legs 52 in a manner similar to those which are attached to the first pair of leg members 28.

Figure 7:
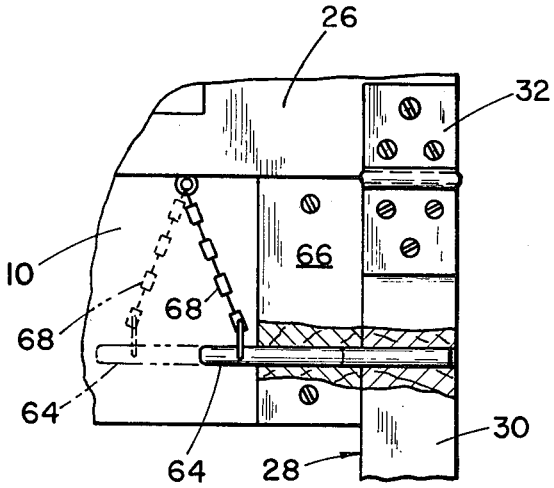
FIG. 7 is a fragmentary enlarged view showing in partly broken-away manner details of means by which the front pair of legs are latched in extended, operative position in parallel relationship to the horizontal frame member, the pin being shown in operative position in full lines and, in phantom, said pin is illustrated in disengaged position relative to the leg to permit the same to be pivoted to collapsed, compact position.

When the first and second pairs of leg members 28 and 52 are disposed in operative, downwardly extending position with respect to the horizontal frame member 10, as shown in FIG. 3, the first pair of leg members 28 are disposed parallel to the plane of the horizontal frame member 10 and said legs are maintained in said position by pins 64 which extend through longitudinally aligned holes formed respectively in the upper portions of the hinged legs 30 of composite leg members 28 and a rigid block 66 which is secured by screws, for example, to the forward face of horizontal frame member 10 as shown in FIG. 7 in detail. Preferably, the pins 64 are secured to supplemental frame members 26 by a chain 68 so as to prevent loss of or separation of the pins from the easel. An additional chain 70 also extends from each of the opposite ends of the transverse brace member 40 substantially horizontally toward the second set of legs 52 for engagement of a link of said chains with a hook 72 on the hinged leg 54 of each of said second pair of legs 52 in order to dispose the second pair of legs 52 at an acute angle with respect to the first pair of legs 28 and thereby dispose the easel in a vertically supported position as shown in exemplary manner in FIG. 3, it being understood that the slope of the easel and especially the support 12 thereof may be regulated to suit the desire of the user. The chains 70 also have an additional use described hereinafter.

Figure 8:
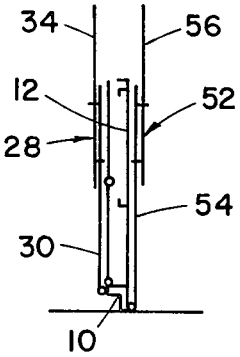
FIGS. 8–10 respectively are stick drawings respectively illustrating successive steps in changing the easel of the present invention from compact, collapsed condition to extended, operative position and in which in FIG. 8, it will be seen that the leg extentions are first moved upwardly to extend the same relative to the hinged members of the legs, FIG. 9 showing the next step in which the front and rear pairs of legs are both moved in opposite directions away from opposite sides of the horizontal frame member and the support which extends upward therefrom, and in FIG. 10, it will be seen that the horizontal frame member and support have been raised vertically to permit the forward and rearward pairs of legs to extend downward from the lower edge of said frame member and the support thereon, as well as the hinged panels comprising the shelf and brace means being shown in typical operative position and having been moved thereto from the position shown in FIG. 9 in which said panels overlie one face of the support which extends upward from said horizontal frame member.
Figure 9:
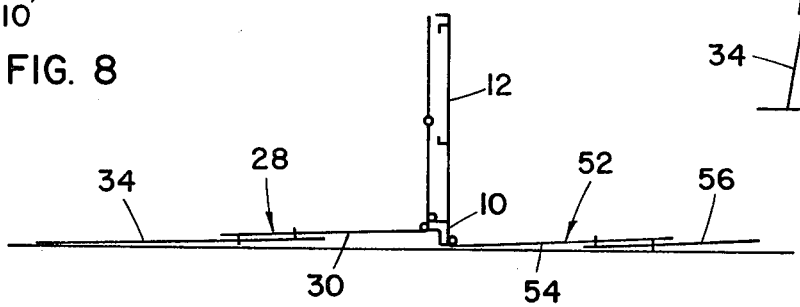

When the easel is in its collapsed, compact condition, such as shown in FIGS. 1 and 2, the first and second pairs of legs 28 and 52 are folded with respect to the horizontal frame member 10 so as to extend therefrom in the same direction as the support 12. The first pair of legs 28 are then disposed in a plane immediately forward of and parallel to the front faces of the horizontal grooved rails 18 and 20, while the legs of the second pair 52 respectively are substantially within the same plane as the support 12 which, as shown in FIG. 1, is relatively narrow and the second pair of legs 52 are transversely spaced a substantial distance from opposite edges of the support 12 so that there is no conflict therebetween. When in this condition, the chains 70 exercise the second function thereof referred to above, namely, being wrapped around the uppermost ends of the first and second pairs of legs 28 and 52 to hold the same in compact, collapsed condition. When in this condition, the outer leg members of each of said pairs of legs 28 and 52 are in fully contracted position with respect to the hinged leg members of each of said pairs of legs so as to render the same in the most compact position thereof and contribute to the minimal vertical height of the collapsed easel as shown in FIGS. 1 and 2. When it is desired to extend the various components of the easel into the projected, operative position as shown for example in FIG. 3, attention is directed to FIGS. 8, 9 and 10 in which successive steps are illustrated. For example, in FIG. 8, the first step is shown as comprising the extention of the outer legs 34 of the first pair of legs 28 and the outer legs 56 of the second pair of legs 52. In FIG. 9, it will be seen that the extended pairs of legs 28 and 52 have been pivoted downwardly into engagement with a supporting surface such as the ground or floor through an arc of substantially 90°, leaving the support 12 upright. The upper end of support 12 is also provided with a transverse slot which forms handle 74. The handle is useful not only to carry the collapsed and compact easel but when the easel is in the condition such as shown in FIG. 9, the handle may be engaged to raise the horizontal frame member 10 and support 12 vertically upward and under such circumstances, the pairs of legs 28 and 52 will normally be extended downward by gravity and when the first pair of legs 28 are in alignment with the plane of the horizontal frame member 10 as shown in FIG. 3, the pins 64 are projected into the aligned holes in the hinged legs 30 of said first pair of legs 28 and the rigid blocks 66, following which the chains 70 are attached to the hook 72 on the second pair of legs 52 at desired positions depending upon the angle at which it is desired to dispose the support 12.

Another important feature of the present invention comprises an articulated shelf arrangement 76 which is composed of a pair of panels of suitable material such as plywood, pressboard or other suitable rigid material from which the shelf panel 78 and brace panel 80 are formed. As shown in FIG. 1, these panels have a width preferably equal to that of the entire transverse dimension of the easel. Also, the overall length of the articulated shelf arrangement 76 when extended upwardly to overlie the artist canvas 22, as shown in phantom in FIG. 3, is adequate to extend above the upper horizontal groove rail 18 so as to protect the face of said painting when the easel is arranged in collapsed, compact form as shown in FIGS. 1 and 2, in which position the uppermost edge of panel 80 is latched by latches 80', see FIG. 1, to a transverse bar 81, of similar length to panel 80 and fixed to support 12.

Figure 10:
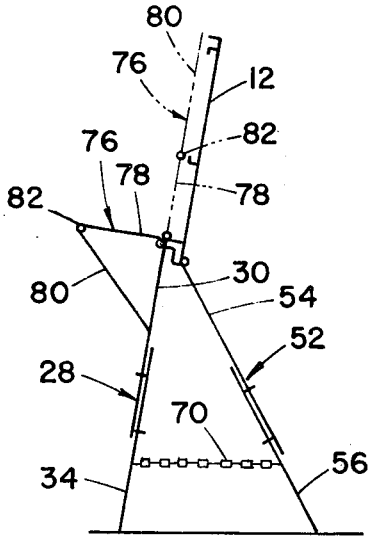

To dispose the shelf arrangement 76 in operative position such as shown in full lines in FIG. 3, it will be seen that the shelf and brace panels 78 and 80 are connected along one edge of each by hinge means 82. The opposite edge of shelf panel 78 is connected by additional hinge means 84 to the upper edge of supplemental frame member 26. As indicated in FIG. 10, the final setup step in disposing the easel in operative position comprises the arrangement of the articulated shelf 76 in operative position as shown diagrammatically in FIG. 10 and in which the shelf arrangement 76 is moved from the vertical, planar position by hinging the arrangement downwardly to dispose the shelf panel 78 substantially horizontally or perpendicularly to the plane of the support 12 and the brace panel 80 then is extended inwardly and downwardly to engage the lower edge thereof with hinged leg members 30 of the first pair of legs 28 until the desired position of the shelf panel 78 is established to the liking of the artist. Adjustable positioning of the same is permitted, as indicated in several alternate phantom positions shown in FIG. 3, by disposing positioning pins 86 in a selected hole of a series of holes 88 formed at an angle to the plane of the hinged leg members 30 of the first pair of legs 28 as shown in FIG. 3, thereby firmly positioning the bracing panel 80 to maintain the desired position of the shelf panel 78 for purposes of holding various tools or other accouterments normally used by an artist. To prevent loss of the pins 86, they preferably are connected to the hinged leg members 30 by an appropriate chain 90.

One incidental use of the shelf panel 78 is to support a pocket member 92, see FIG. 3, which may be attached to one end of the shelf panel 78 by appropriate hooks or otherwise. In the collapsed condition of the easel as shown in FIG. 1, the pocket member 92 may be temporarily affixed to one face of the horizontal frame member 10 by any suitable means such as hooks or otherwise. The pocket member 92 is handy for purposes of containing brushes and other items used by an artist.

In order that the overall vertical dimension of the collapsed easel and especially the length of the support 12 will not be unduly extensive, yet also permit the positioning of canvas or artists boards upon the easel which may be of a greater vertical dimension than that normally afforded by the support 12, the present invention has vertically movable, auxiliary supporting members 94 which may be formed from rod material and the upper ends thereof are bent transversely to the supporting members 94 to form lateral extensions 96 that preferably terminate in hook-like configurations so as to suitably engage the upper edge of an unusually tall canvas or artist board 22' as illustrated in exemplary manner in FIG. 5 in which the canvas or board 22' extends vertically above the upper horizontal rail 18 which normally engages the canvas or board. A plurality of appropriate guides 98 are provided through which the vertical auxiliary supporting members 94 extend and one of these is provided with a thumb screw 100 for purposes of tightening the auxiliary supporting members 94 in the desired operative position thereof. By loosening the thumb screws 100 the members 94 may be restored to the lower, compact position thereof shown in FIG. 1 in which the lateral extensions 96 are disposed preferably in a horizontal plane parallel to the the rear surface of support 12 and in which position extensions 96 lie against transverse bar 81 in the compact, collapsed arrangement of the easel, as shown in FIG. 1.

Figure 6:
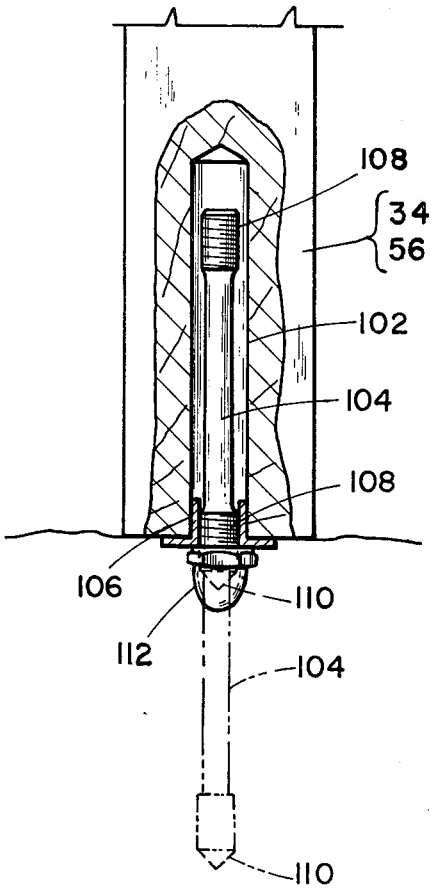
FIG. 6 is a fragmentary side elevation, in enlarged scale, partly broken away, and illustrating details of projectable pointed members shown in the lower ends of the legs of the easel, said members being illustrated in full lines in retracted position and, in phantom, being shown in projected positions.

Still another useful and desirable feature of the easel comprising the present invention is illustrated in FIG. 6 in which it will be seen that the lower extremities of the outer leg members 34 and 56 of the first and second pairs of legs 28 and 52 are provided with axial bores 102 which receive adjustably projectable pointed members 104, the opposite ends of which are threaded for engagement with internal threads in a flanged ferrule 106 which is fitted into the outer end of bore 102. In the inoperative position of the pointed members 104, which is shown in full lines in FIG. 6, the lower threads 108 on member 104 engage the threads on the inside of ferrule 106, while when the members 104 are in the extended position thereof shown in phantom in FIG. 6, the inner threads 110 engage the threads of ferrule 106. The principal purpose of the pointed members 104 is to provide means to be projected into turf or any other yieldable surfaces upon which the easel is to be positioned and prevent slipage of the bottoms of the legs with respect to said surface. Also, when in the retracted, stored position of the members 104, the pointed ends 110 thereof may be covered by suitable internally threaded caps 112 which engage the lower threads 108 of the pointed member 104 when the latter is in stored position and thereby prevent the pointed end 110 from damaging any supporting surface such as a polished floor or otherwise.

From the foregoing, it will be seen that the present invention provides a collapsible easel which in the compact, collapsed arrangement thereof is of convenient size to permit ready storing of the same in a closet or to have the same transported in a passenger vehicle or the like. The weight thereof is relatively light so that it can be handled readily manually. More important, in addition to the ready means by which the legs are disposed in operative, supporting position for the frame and support of the easel, the same is provided with an articulated shelf arrangement which serves the dual purpose to provide a shelf and in addition, is extendible in planar manner to overlie a sketch or painting retained in the supporting means therefor within the easel when the easel is in collapsed arrangement, yet the shelf arrangement readily is manipulated to dispose the same as a shelf for the intended purpose of supporting a number of the tools or accouterments normally employed by an artist.

The foregoing description illustrates preferred embodiments of the invention. However, the concepts employed may, based upon such description, be employed in other embodiments without departing from the scope of the invention. Accordingly, the following claims are intended to protect the invention broadly, as well as in the specific forms shown herein.

I claim:

1. A collapsible easel for use by an artist comprising in combination, an elongated relatively narrow normally horizontal frame member having opposite faces, a relatively narrow support member connected at one end to said frame member and extending perpendicularly therefrom, a first pair of longitudinally adjustable legs pivotally connected at one end to opposite end portions of one face of said frame member, a second pair of longitudinally adjustable legs pivotally connected at one end to opposite end portions of the other face of said frame member, the legs of said pairs being perpendicular to the elongated axis of said frame member and said pairs of legs respectively being pivotally movable in opposite directions relative to each other through arcs of substantially 180° relative to the elongated axis of said frame member respectively between compact folded position adjacent opposite surfaces of said support and extended supporting positions in which said legs all extend from said frame member in opposite directions from said support, a pair of normally horizontal rails extending transversely to the vertical axis of said support member and relatively adjustable to said member and each other, said rails also having grooves therein facing each other to engage opposite horizontal edges of an artist's canvas or boards, a pair of elongated panels hingedly connected along one edge to each other, means connecting the opposite edge of one panel to said frame member to form a shelf when extending horizontally in use from said frame member, the other panel comprising a brace and being adapted to extend downward and inward from the outer edge of said shelf panel for engagement with the first pair of legs to brace said shelf panel substantially in operative horizontal position, pin means adjustably positionable longitudinally at desired selected positions along said first pair of legs below the pivotal connection thereof to said frame member and said first pair of legs having similar rows of holes extending transversely therein to receive said pins in similar selected holes in each row for engagement by the lower edge of said brace panel when the pairs of legs are disposed in downwardly extending supporting position for said horizontal frame member and support thereon, and said panels further being adapted to be disposed in extended planar relation to each other and be hingedly moved into a compact extended position overlying the normally front face of said support member and protect the face of any painting or artist's panel mounted upon said support member for carrying purposes.

2. The collapsible easel according to claim 1 further including a plurality of transversely spaced vertically extensible auxiliary supporting means longitudinally adjustable upon said support member and having means at the upper end thereof extending transversely and adapted to engage the upper edge of an artists' canvas or board when the vertical dimension of the latter is greater than the length of said support member.

3. The collapsible easel according to claim 2 in which said support member comprises a flat member normally extending upward from said horizontal frame member, and said vertically extensible auxiliary supporting means comprising rod-like members supported in guides upon opposite edges of said support member and said means at the upper ends thereof comprising lateral extensions operable to engage said upper edge of an artists' canvas or board, and clamp means on said support engageable with said rod-like members to secure the same in desired vertically adjusted positions.

4. The collapsible easel according to claim 1 in which the legs of said first and second pair thereof are of a compound nature and each comprising a first leg member which is hingedly connected to said horizontal frame member and a longitudinally extensible outer leg member of similar cross-sectional shape to said first leg member and slidable therealong and having an outer end engageable with a supporting surface, said outer leg members having adjustable projectable pointed members longitudinally movable relative to the normally lower ends of said outer leg members for projection into turf or soil when desired, and guide members carried by one of said leg members and slidably engaging the other leg member to provide accurate longitudinal alignment of the legs with each other.

5. The collapsible easel according to claim 1 in which said relatively narrow support member is flat and has a transverse slot therethrough at the end thereof opposite the end connected to said horizontal frame member to form a handle member and said handle projecting above the upper edge of said hingedly connected flat shelf and brace panels when in compact extended overlying position relative to said support.

6. The collapsible easel according to claim 1 further including a bar connected to the upper portion of said support member and extending transversely thereto, said bar being substantially as long as said panels and positioned upon said support at a location to be engaged by the uppermost edge portion of said panels when extended in planar manner and moved into said compact position thereof, and latch means interengaging said bar and upper edge portions of said panels in said compact position to secure the same in said position for transport and storage.

* * * * *